US011693332B2

(12) United States Patent
Tanaka et al.

(10) Patent No.: US 11,693,332 B2
(45) Date of Patent: Jul. 4, 2023

(54) TONER/DEVELOPER SUPPLY DEVICE FOR SEPARATE SUPPLY OF DEVELOPER AND TONER

(71) Applicant: HEWLETT-PACKARD DEVELOPMENT COMPANY, L.P., Spring, TX (US)

(72) Inventors: Kenji Tanaka, Kanagawa (JP); Takahiko Kimura, Kanagawa (JP)

(73) Assignee: Hewlett-Packard Development Company L.P., Spring, TX (US)

( * ) Notice: Subject to any disclaimer, the term of this patent is extended or adjusted under 35 U.S.C. 154(b) by 0 days.

(21) Appl. No.: 17/763,356

(22) PCT Filed: Sep. 17, 2020

(86) PCT No.: PCT/US2020/051169
§ 371 (c)(1),
(2) Date: Mar. 24, 2022

(87) PCT Pub. No.: WO2021/071642
PCT Pub. Date: Apr. 15, 2021

(65) Prior Publication Data

US 2022/0334517 A1 Oct. 20, 2022

(30) Foreign Application Priority Data

Oct. 10, 2019 (JP) ..... 2019-186538

(51) Int. Cl.
*G03G 15/08* (2006.01)

(52) U.S. Cl.
CPC ..... *G03G 15/0881* (2013.01); *G03G 15/0867* (2013.01)

(58) Field of Classification Search
CPC ..... G03G 15/0867; G03G 15/0881
USPC ..... 399/106, 107, 110, 119, 120, 252–258
See application file for complete search history.

(56) References Cited

U.S. PATENT DOCUMENTS

| | | | |
|---|---|---|---|
| 7,720,416 | B2 | 5/2010 | Taguchi et al. |
| 8,238,796 | B2 | 8/2012 | Yoshida et al. |
| 8,693,926 | B2 | 4/2014 | Nagashima et al. |
| 9,753,401 | B2 | 9/2017 | Yamane et al. |

FOREIGN PATENT DOCUMENTS

| | | | |
|---|---|---|---|
| CN | 101038466 | * | 9/2007 |
| CN | 103186073 | * | 7/2013 |
| JP | 1994-43754 | A | 2/1994 |
| JP | 2000-10392 | A | 1/2000 |
| JP | 2000-214669 | A | 8/2000 |
| JP | 2001-66864 | A | 3/2001 |
| JP | 2002-244416 | A | 8/2002 |
| JP | 2016173515 | * | 9/2016 |

* cited by examiner

*Primary Examiner* — Hoan H Tran
(74) *Attorney, Agent, or Firm* — Foley & Lardner LLP

(57) ABSTRACT

A toner-and-developer supply device includes a toner container to contain toner and a developer container to contain a developer. The toner container has a toner discharge port, and the toner container is rotatable about a rotational axis to transport the toner toward the toner discharge port. The developer container has a toner-and-developer discharge port. The developer container is rotatably coupled to the toner container to transport the developer toward the toner-and-developer discharge port when the toner container rotates in a given direction relative to the developer container.

15 Claims, 11 Drawing Sheets

TONER/DEVELOPER SUPPLY DEVICE FOR SEPARATE SUPPLY OF DEVELOPER AND TONER

BACKGROUND

Some image forming apparatuses using a two-component developer containing a toner and a carrier, include a developing device that is charged with a developer at manufacture while others have a developing device that is not charged with any developer.

For an image forming apparatus that is shipped out from a manufacturer, with a developing device charged with a developer, various sealing treatments such as attachment of a sealing member are to be provided to the developing device at production of the image forming apparatus in order to prevent any leak (or leakage) of the developer from the developing device that may be caused by vibrations or the like during transportation. After that image forming apparatus is installed at a customer's site or the like, a service personnel, for example, may perform various tasks including: taking out the developing device from the image forming apparatus and removing the sealing members from the developing device, and then, mounting the developing device to the image forming apparatus.

In the case of an image forming apparatus that is shipped out from a manufacturer with a developing device empty without being filled with a developer, for example, a service personnel may perform, at a customer's site or the like where the image forming apparatus is installed, tasks including: taking out the developing device from the image forming apparatus, opening a cover of the developing device, feeding a developer contained in a bottle or bag into the developing device, closing the cover of the developing device, and mounting the developing device to the image forming apparatus.

Some image forming apparatuses that are shipped out with a developing device that is empty, without having been filled with any developer, have another configuration. Such an image forming apparatus has a developer reservoir provided in part of the developing device. In order to prevent a leak of developer from the developer reservoir to the developing device that may be caused by vibrations or the like during transportation, a sealing treatment may be carried out, such as attaching a sealing member to a connecting portion of the developer reservoir for the developer, to the developing device. When such an image forming apparatus is installed at a customer's site or the like, for example, a service personnel may perform tasks including: taking out the developing device from the image forming apparatus, removing the sealing member from the developer reservoir, and then, mounting the developing device to the image forming apparatus.

In addition, the developer within the developing device deteriorates whenever the image forming apparatus performs a printing operation. The deterioration of the developer results in a reduction of printing quality, and therefore the developer should be replaced at a given time. In this case, for example, a service personnel may perform, at a customer's site, tasks including: taking out the developer device from the image forming apparatus, opening a cover of the developing device, draining the developer from the developing device to collect it in a developer collection container, feeding a new developer contained in a bottle or bag into the developing device, closing the cover of the developing device, and mounting the developing device to the image forming apparatus.

DETAILED DESCRIPTION

Figure 1:
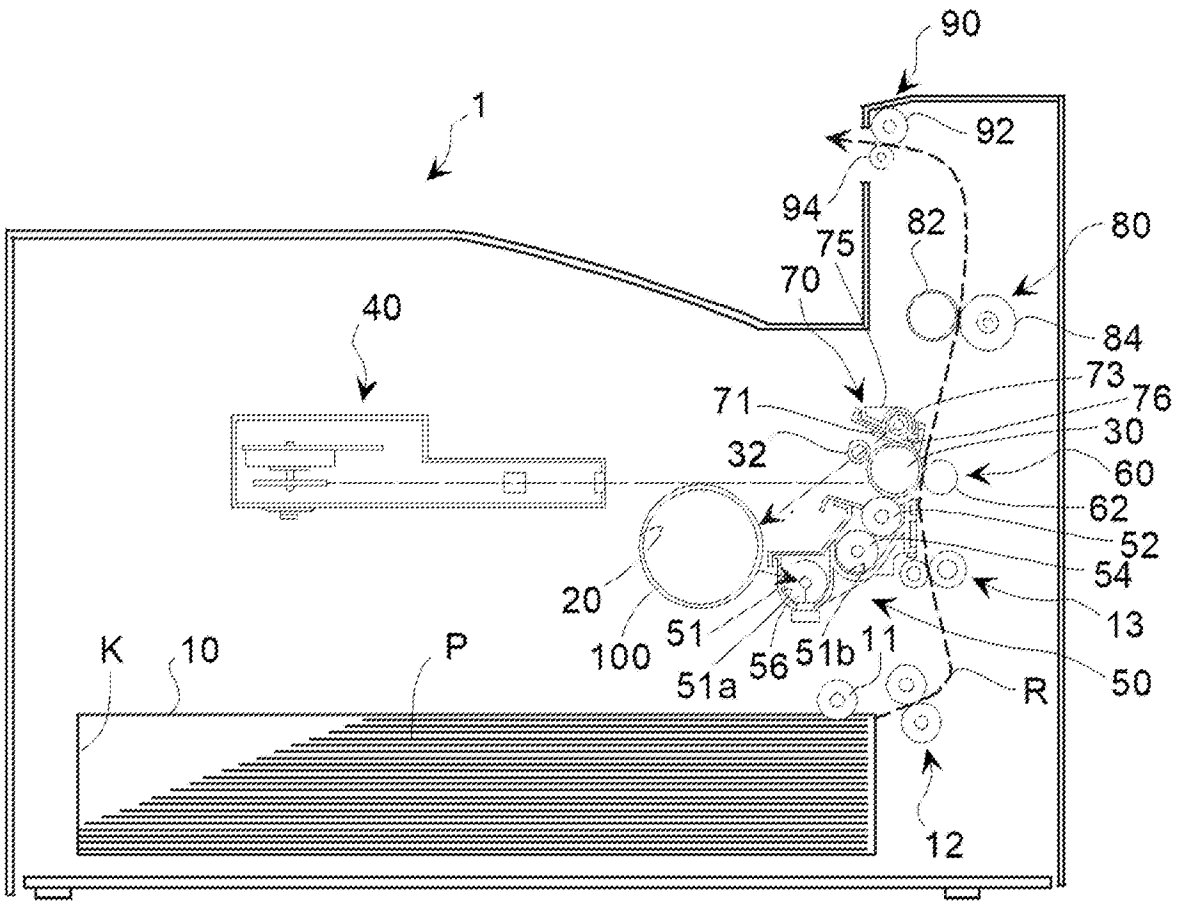
FIG. 1 is a schematic diagram of an example image forming apparatus.

In the following description, with reference to the drawings, the same reference numbers are assigned to the same components or to similar components having the same function, and overlapping description is omitted.

An example toner/developer supply device (also referred to as a toner-and-developer supply device) may supply a toner and a developer separately to a developing device using a two-component developer. The toner/developer supply device can have a toner container rotatable about a rotational axis (e.g., cylinder axis) to transport the toner contained in the toner container toward a toner discharge port. The toner/developer supply device can also be provided with a developer container having a toner/developer discharge port (also referred to as a toner-and-developer discharge port). The toner container may be coupled to the developer container and may be rotatable relative to the developer container. The toner container may rotate in a given direction relative to the developer container, to transport the developer contained in the developer container toward the toner/developer discharge port of the developer container.

According to examples, the developer container can have a toner inlet port and a seal mechanism can be provided to seal the toner discharge port. The seal mechanism can be adapted to be removable from the toner discharge port to fluidly communicate the toner discharge port with the toner inlet port when the toner container has rotated relative to the developer container beyond a predetermined range of angles (e.g., within a range of threshold rotational angles).

According to examples, the toner container can have an inner wall that is formed with a spiral projection to transport the toner contained in the toner container toward the toner discharge port. A developer transport mechanism can be disposed at one end of the toner container, and the developer transport mechanism can include a scraper member. The scraper member can have an end (e.g., a free end) extending radially outwardly within the developer container to contact the inner wall of the developer container, and the end can extend in a direction substantially parallel with the cylinder axis of the developer container.

According to examples, the end of the scraper member that contacts the inner wall of the developer container can extend in a direction slightly intersecting a direction parallel with the cylinder axis of the developer container.

According to examples, the developer container has an openable closure mechanism (e.g., openable closure device or coupling) to close the toner/developer discharge port of the developer container, for example to close the toner/developer discharge port when the toner/developer supply device is unused and to open the toner/developer discharge port when the toner/developer supply device is mounted to an image forming apparatus.

According to examples, the seal mechanism can include a sealing member (or seal) having a first end portion attached to a periphery of the toner discharge port of the toner container to seal the toner discharge port, an intermediate portion that is extendable to a threshold length or a maximum length (e.g., extendable to a predetermined length or maximum length but unextendable beyond the predetermined length), and a second end portion attached to the inner wall of the developer container. An attaching force of the first end portion of the sealing member to the periphery of the toner discharge port of the toner container can be less than an attaching force of the second end portion of the sealing member to the inner wall of the developer container.

According to examples, the toner container includes a bottle having a substantially cylindrical shape that defines the predetermined cylinder axis (e.g., longitudinal center axis of the cylindrical shape), with an opening at one end (e.g., an open end or a longitudinal end) along the cylinder axis, and a cap member coupled to the one end of the bottle, and the toner discharge port of the toner container can be formed in the cap member to fluidly communicate with the opening of the bottle.

According to examples, the developer container can be adapted to couple with the bottle by snap-fitting, with the cap member and the one end of the bottle being located within the developer container, such that the cap member and the bottle are rotatable relative to the developer container.

According to examples, an image forming apparatus is provided with the toner/developer supply device.

According to examples, the toner container of the toner/developer supply device can be connected to a rotatably controllable coupling in the image forming apparatus, and the developer container of the toner/developer supply device can be unrotatably connected in the image forming apparatus (e.g., connected in a non-rotating manner, so as to be rotatably fixed with the image forming apparatus).

According to examples, when the developing device is not charged with a developer, the toner/developer supply device may contain within the developer container, a predetermined amount of a developer to be charged into the developing device.

According to examples, a developer discharge mechanism to discharge at least part of deteriorated developer contained in the developing device to the outside of the developing device can be provided. After at least part of the deteriorated developer contained in the developing device is discharged to the outside of the developing device by the developer discharge mechanism, the toner/developer supply device containing in the developer container, a new developer in the same amount as the discharged deteriorated developer can be used.

According to examples, the developer discharge mechanism can include a developer discharge port disposed in a circular path of developer in the developing device and an opening/closing mechanism to open and close the developer discharge port, and the opening/closing mechanism can open the developer discharge port to discharge the deteriorated developer.

According to examples, the developer discharge mechanism includes a controller to control a surface potential of an image carrier of the image forming apparatus and a developing bias potential of a developing roller of the developing device. The controller can control the surface potential of the image carrier and the developing bias potential of the developing roller to attract the deteriorated developer to the image carrier such that the deteriorated developer adheres to the image carrier, and the deteriorated developer adhered to the image carrier can be scraped by a cleaning blade to be discharged.

According to examples, an example method of supplying a toner and a developer in the image forming apparatus can be provided. Upon mounting the toner/developer supply device to the image forming apparatus, the developer contained in the developer container may be discharged through the toner/developer discharge port of the developer container, to charge the developing device by repeatedly rotating the toner container of the toner/developer supply device relative to the developer container of the toner/developer supply device within the predetermined range of angles. When the developing device is to be replenished with toner, after completion of the charging of the developing device with the developer, the seal mechanism can be removed from the toner discharge port of the toner container by rotating the toner container relative to the developer container beyond the predetermined range of angles. Then, the toner container can be rotated in the predetermined direction to supply the toner contained in the toner container to the toner discharge port of the toner container, and then to the developing device through the toner/developer discharge port of the developer container. Another example method includes supplying the developer to a developing device of the image forming apparatus, and subsequently supplying toner to the developing device. The developer is supplied by repeatedly rotating a toner container of a toner-and-developer supply device relative to a developer container of the toner-and-developer supply device within a range of threshold angles to discharge the developer contained in the developer container to the developing device. The toner is supplied by rotating the toner container relative to the developer container beyond the range of threshold angles to remove a seal from a toner discharge port of the toner container, and by further rotating the toner container in a predetermined direction to supply the toner contained in the toner container via the toner discharge port, through the developer container, and to the developing device.

FIG. 1 is a schematic diagram of an example image forming apparatus 1 including a toner/developer cartridge (or toner-and-developer cartridge) 100 as an example toner/developer supply device. The image forming apparatus 1 can be a monochrome printer or a copier, which forms an image by use of, for example, the toner/developer cartridge 100.

An example image forming apparatus 1 has a transport device 10, a cartridge section 20, an image carrier 30, an exposure device 40, a developing device 50, a transfer device 60, a cleaning device 70, a fixing device 80, and a discharge device 90.

The transport device 10 transports, on a transport path R, a paper sheet P as a recording medium, on which an image is to be formed. An example transport device 10 includes, on the transport path R, a pick-up roller 11, a separation roller 12 and a registration roller 13. Paper sheets P are contained in a cassette K in a stacked manner. A paper sheet P is picked up by the pick-up roller 11 and transported to the transport path R. Paper sheets P transported on the transport path R are separated sheet by sheet by the separation roller 12. The separated paper sheet P is transported by the registration roller 13 to a transfer region at a predetermined timing as described further below.

The cartridge section 20 contains a toner/developer cartridge (or toner-and-developer cartridge) 100 and rotatably supports the contained toner/developer cartridge 100. An example toner/developer cartridge 100 can have a substantially cylindrical shape or a columnar outer appearance, and the cartridge section 20 can also have a substantially cylindrical shape. FIG. 1 illustrates the cartridge section 20 having substantially a cylindrical shape and extending in a longitudinal direction which is perpendicular (or orthogonal) to the figure.

The image carrier 30 may also be referred to as an electrostatic latent image carrier or a photosensitive drum. The image carrier 30 has a columnar shape having a rotational axis in the longitudinal direction (e.g., in a direction perpendicular to FIG. 1). An electrostatic latent image is formed on a circumferential surface of the image carrier 30. A charging roller 32 is disposed adjacent to the image carrier 30. The charging roller 32 uniformly charges a surface of the image carrier 30 at a predetermined potential. The charging roller 32 can rotate to follow the rotation of the image carrier 30.

The exposure device 40 exposes the surface of the image carrier 30 having been uniformly charged, to light in accordance with an image formed on a paper sheet P. This changes a potential of a portion, exposed by the exposure device 40, of the circumferential surface of the image carrier 30, so as to form an electrostatic latent image on the circumferential surface of the image carrier 30.

The developing device 50 allows the electrostatic latent image formed on the circumferential surface of the image carrier 30 to adsorb a toner, in order to develop the electrostatic latent image and form a toner image. An example developing device 50 has a developing roller 52, and stirring-transporting members 54, 56.

The developing roller 52 and the stirring-transporting members 54, 56 are contained in a housing 51. In the housing 51, a transport path 51*a* having the stirring-transporting member 56 disposed therein, and a transport path 51*b* having the stirring-transporting member 54 disposed therein are formed. The developing roller 52 is disposed above the stirring-transporting member 54 in the transport path 51*b*. A portion of the developing roller 52 in a circumferential direction is exposed from the housing 51 (e.g., exposed to an outside of the housing 51).

The developing roller 52 and the stirring-transporting members 54, 56 have respective rotational axes that extend in parallel. The housing 51 is filled with a two-component developer containing a toner and a carrier. The stirring-transporting member 56 transports the developer in the transport path 51*a* in a direction (e.g., an axial direction) along the rotational axis of the stirring-transporting member 56 while stirring. The developer transported to one end of the stirring-transporting member 56 is transported by a predetermined mechanism to the transport path 51*b* adjacent to the transport path 51*a*. The stirring-transporting member 54 transports the developer in the transport path 51*b* in a direction along the rotational axis of the stirring-transporting member 54. The developer transported through the transport path 51*b* is magnetically adsorbed to the surface of the developing roller 52. Then, the toner contained in the developer magnetically adsorbed to the surface of the developing roller 52 is supplied to the electrostatic latent image of the image carrier 30.

An example developing device 50 has a toner concentration sensor to measure a toner concentration of the developer disposed therein. For example, when the toner concentration sensor detects that the toner concentration of the developer becomes equal to or lower than a predetermined value, a control device controls a discharge of toner from the toner/developer cartridge 100 to replenish the developing device 50 with a toner.

The transfer device 60 includes a transfer roller 62. The transfer roller 62 has a rotational axis parallel to the rotational axis of the image carrier 30. The circumferential surface of the transfer roller 62 contacts the circumferential surface of the image carrier 30 to form a transfer region. The transfer roller 62 applies an electric field to a paper sheet P transported to the transfer region, such that the toner image formed on the circumferential surface of the image carrier 30 is electrically transferred to the paper sheet P.

The cleaning device 70 collects an untransferred toner remaining on the image carrier 30 after the toner image formed on the image carrier 30 is transferred onto the paper sheet P. The cleaning device 70 has a blade 71 and a collection-transporting member 73. According to examples, the collection-transporting member 73 is accommodated in a transport path 76 formed in a housing 75. The blade 71 comes in contact with a circumferential surface of the rotating image carrier 30 to scrape the untransferred toner remaining on the outer circumferential surface.

The scraped untransferred toner is collected in the housing 75. The collection-transporting member 73 is driven and rotated by a driving device and the untransferred toner collected in the housing 75 is transported in a direction perpendicular to FIG. 1 (e.g., the longitudinal direction).

The fixing device 80 has a heating roller 82 for heating a paper sheet P, and a pressing roller 84 for pressing the heating roller 82 to drive and rotate it. The heating roller 82 has a heat source such as a halogen lamp within the heating roller 82. The fixing device 80 allows the paper sheet P having a toner image transferred from the image carrier 30 to pass through a fixing region formed between the heating roller 82 and the pressing roller 84 so as to fix the toner image on the paper sheet P through heating and pressing of the paper sheet P.

The discharge device 90 has discharge rollers 92, 94 for discharging the paper sheet P having a toner image fixed thereon to the outside of the apparatus.

An example printing process carried out by the example image forming apparatus 1 shown in FIG. 1 will be described. Upon input of an image signal for an image to be printed into the image forming apparatus 1, a control device of the image forming apparatus 1 rotates the pick-up roller 11, to pick up and transport a paper sheet P that is stacked in the cassette K. The charging roller 32 charges the surface of the image carrier 30 uniformly at a predetermined potential. Based on the received image signal, the exposure device 40 irradiates a laser beam to the surface of the image carrier 30 to form an electrostatic latent image on the surface of the image carrier 30.

The developing device 50 develops the electrostatic latent image formed on the circumferential surface of the image carrier 30 to form a toner image on the image carrier 30. The formed toner image is transferred to the paper sheet P from the image carrier 30 in the transfer region, where the image carrier 30 faces the transfer roller 62.

The paper sheet P having the toner image transferred thereto is transported to the fixing device 80. The fixing device 80 melts and fixes the toner image to the paper sheet P when the paper sheet P passes through the fixing region. The paper sheet P is discharged by the discharge device 90 to the outside of the image forming apparatus 1.

Figure 2:
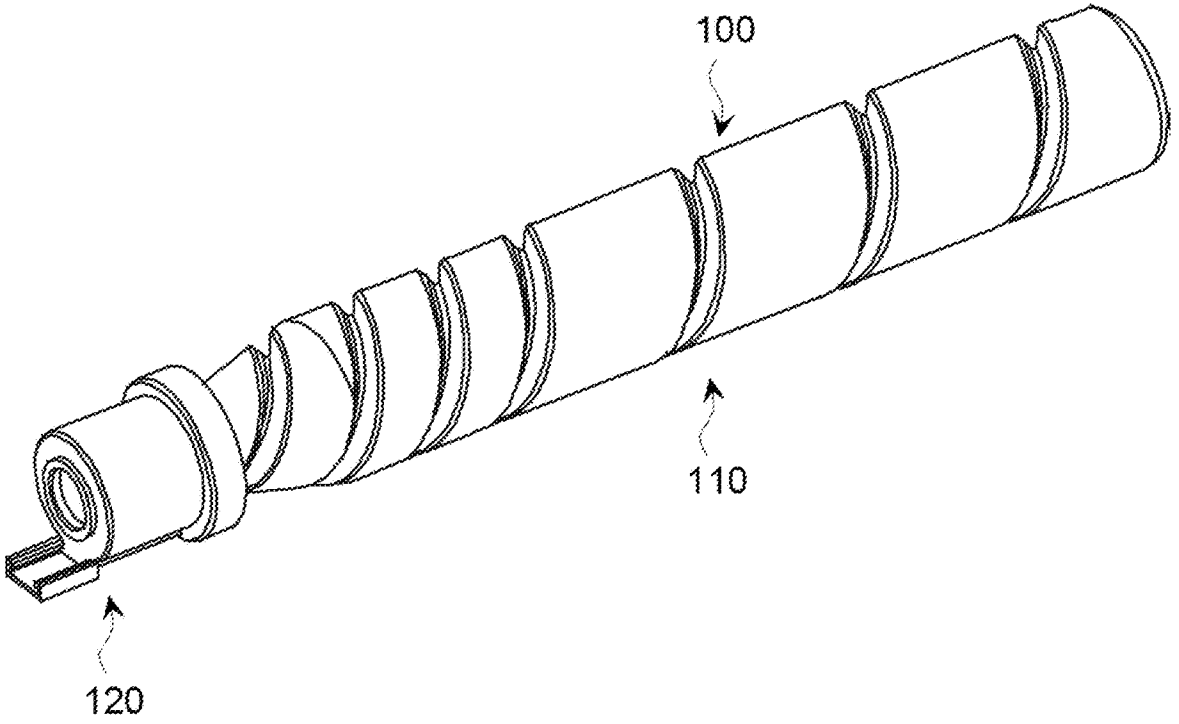
FIG. 2 is a perspective view of an example toner/developer supply device.

FIG. 2 is a perspective view of an example toner/developer cartridge 100 as the toner/developer supply device. The example toner/developer cartridge 100 includes a toner container 110 containing a toner and a developer container 120 containing a developer.

The image forming apparatus 1 described herein can have main frames including, for example, a front frame and a rear frame. The front frame can have openings formed therein for insertion of the developing device 50, the image carrier 30, the toner/developer cartridge 100 and the like. The rear frame can have couplings for controllably driving these devices or terminals for providing a high voltage power supply disposed therein. The developing device 50, the image carrier 30, and the toner/developer cartridge 100 can be disposed between the front frame and the rear frame. For example, the toner/developer cartridge 100 can be inserted into a positioning hole formed in the front frame and its developer container 120 can be fixed in the hole, while the toner container 110 can be fixed to a coupling disposed in the rear frame for the driving and rotation thereof.

Figure 3:
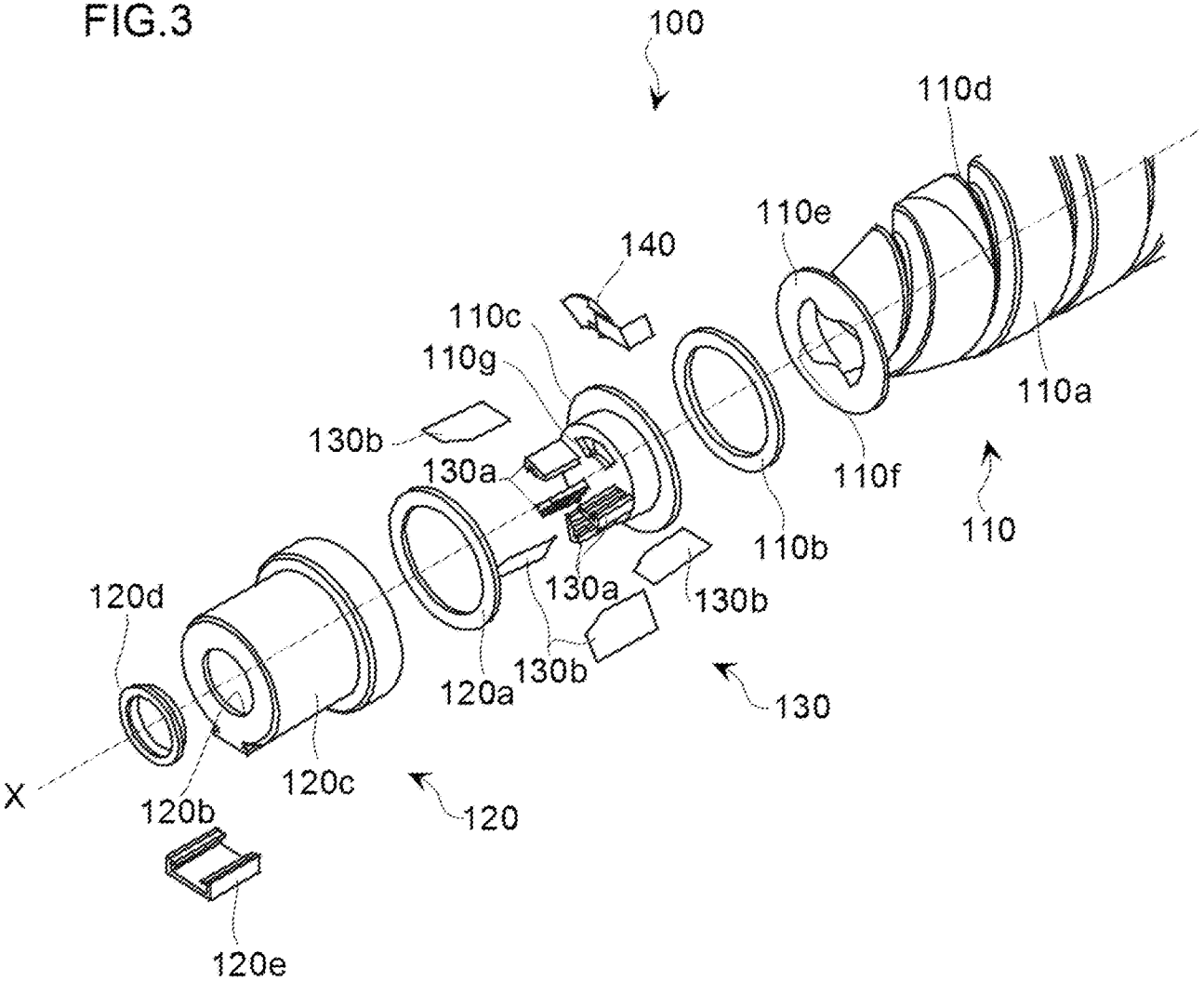
FIG. 3 is a partial exploded perspective view of the toner/developer supply device illustrated FIG. 2.

FIG. 3 is an exploded perspective view of the example toner/developer cartridge 100 of FIG. 2. The toner container 110 includes a bottle 110*a*, a seal ring 110*b* and a cap member 110*c*. The bottle 110*a*, the seal ring 110*b* and the cap member 110*c* can be joined to together by joining means such as a double-sided tape or an adhesive.

The bottle 110*a* has a substantially cylindrical shape overall, and can be formed by blow molding or the like. On an inner wall of the bottle 110*a*, a spiral projection 110*d* is formed. One end 110*e* along the cylinder axis X of the bottle 110*a* has an opening 110*f*. The cap member 110*c* has a toner discharge port 110*g* to fluidly communicate with the opening 110*f*. A sealing member (or seal) 140 is disposed over the toner discharge port 110*g* of the cap member 110*c*.

At a side of the cap member 110*c* facing the developer container 120, a developer transport mechanism 130 is disposed. The developer transport mechanism 130 includes four ribs 130*a*, and four scraper members 130*b* joined to the four ribs 130*a*, respectively. The scraper members 130*b* can be joined to the ribs 130*a* by, for example, joining means such as a double-sided tape or an adhesive.

The developer container 120 includes a seal ring 120*a*, a holder 120*c* having an opening 120*b* for developer replenishment, a cap 120*d* engaged with the opening 120*b* of the holder 120*c*, and a shutter 120*e*. The holder 120*c* can be a molded part having a substantially cylindrical shape.

Figure 4:
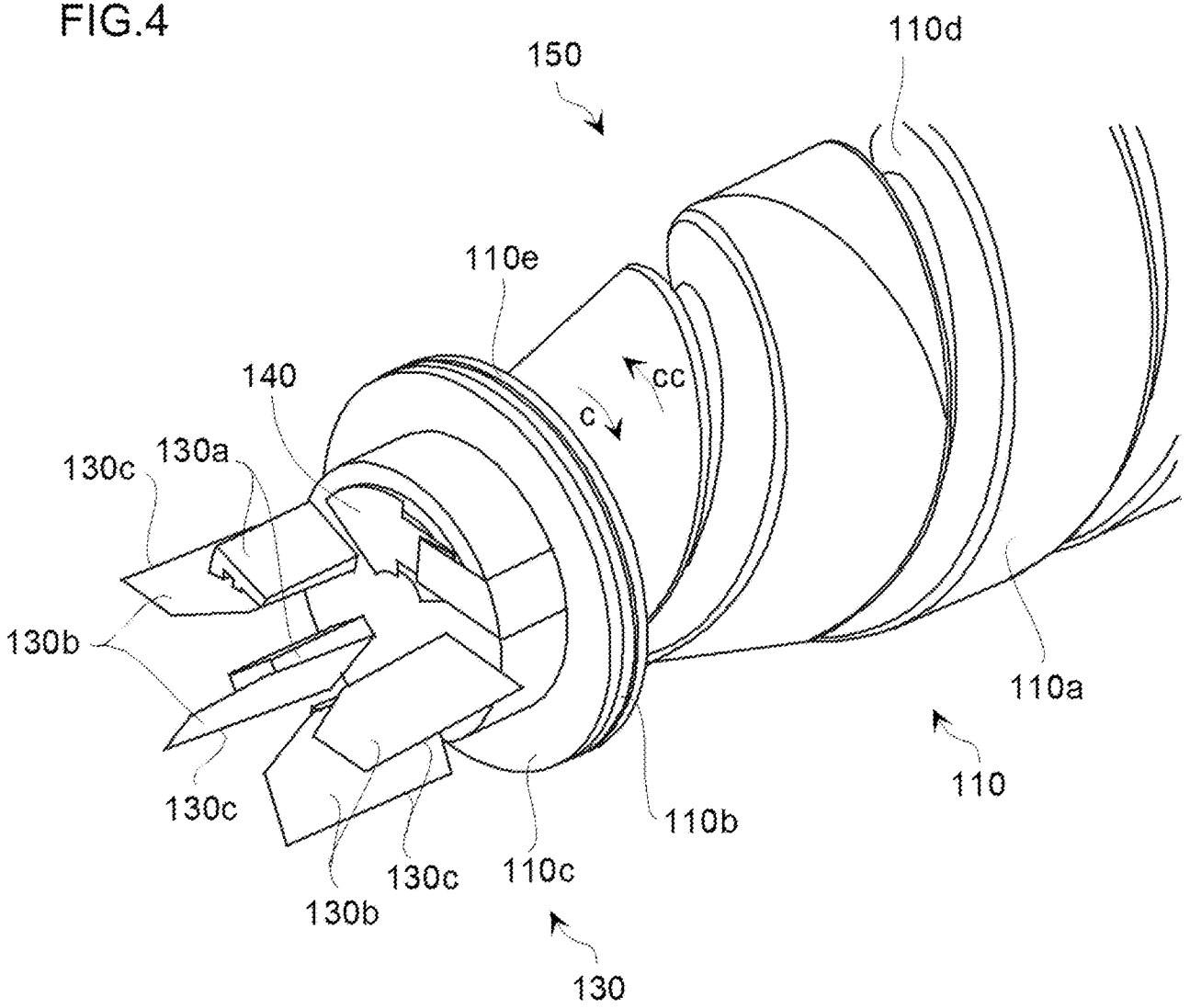
FIG. 4 is a partial enlarged perspective view illustrating an example toner bottle assembly.

FIG. 4 is a partial and enlarged perspective view of the example toner/developer cartridge 100, showing a toner bottle assembly 150 in a state where the above-described toner container 110 and the developer transport mechanism 130 are assembled.

Figure 5:
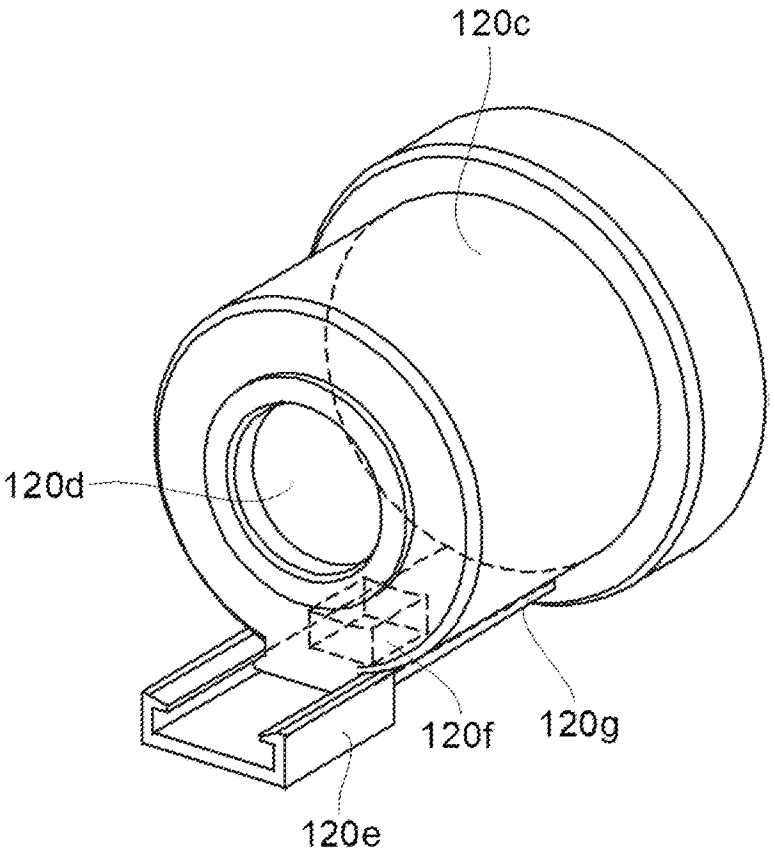
FIG. 5 is a perspective view of an example developer container.
Figure 6:
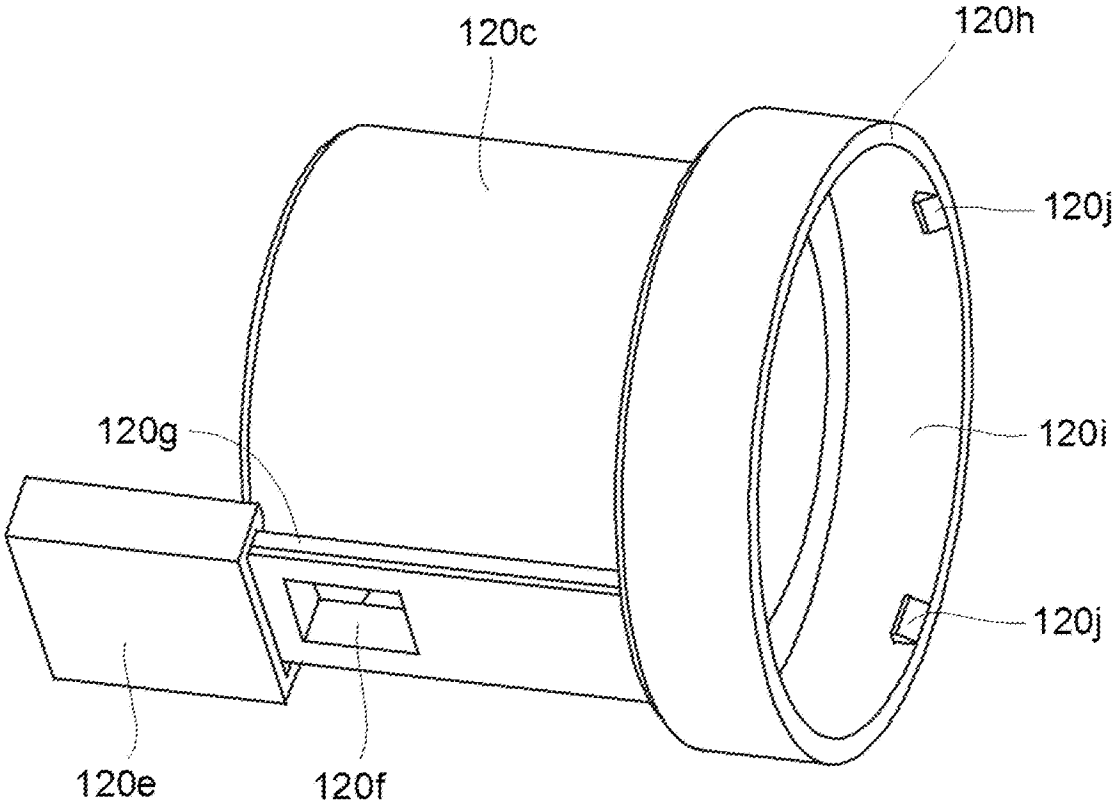
FIG. 6 is a perspective bottom view of the example developer container illustrated in FIG. 5.

FIG. 5 is a perspective view of the above-described developer container 120 of the example the example toner/developer cartridge 100, showing a state where the developer container 120 is assembled. FIG. 6 is a perspective bottom view of the developer container 120 illustrated in FIG. 5.

The developer container 120 has a toner/developer discharge port (or a toner-and-developer discharge port) 120*f* for supplying a toner and a developer to the developing device 50. The shutter 120*e* is configured so as to slide over a rail 120*g* disposed on a bottom surface of the holder 120*c* so as to open the toner/developer discharge port 120*f* when the toner/developer cartridge 100 is mounted to the image forming apparatus.

The developer transport mechanism 130 of the toner bottle assembly 150 shown in FIG. 4 is placed into a toner inlet port 120*i* formed at one end 120*h* of the holder 120*c* shown in FIG. 6, and the end 110*e* of the bottle 110*a* of the toner bottle assembly 150 is pushed into the holder 120*c* beyond hooks 120*j* formed on the end 120*h* of the holder 120*c*, thereby enabling the holder 120*c* to be coupled to the bottle 110*a* via a snap-fitting connection, for examples via respective snap-fit connectors provided on the bottle 110*a* and/or the holder 120*c*.

Figure 7:
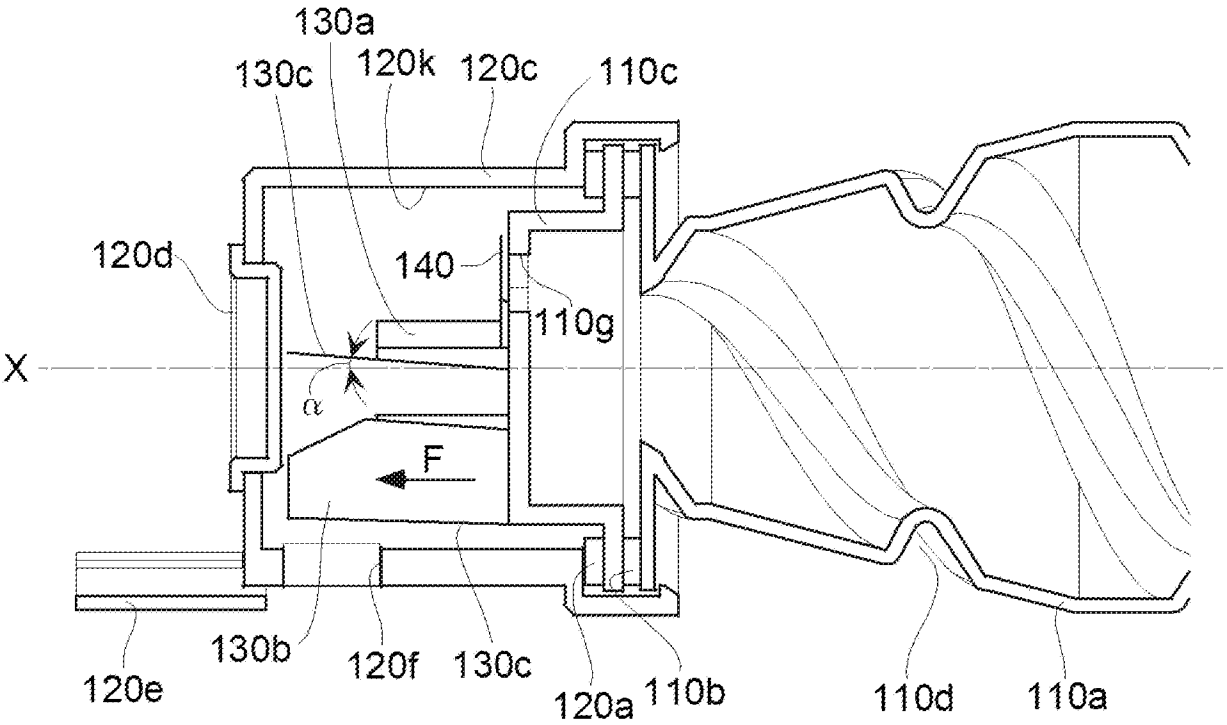
FIG. 7 is a partial cross-sectional view of an example toner/developer supply device, taken along a longitudinal axis of the toner/developer supply device, illustrating a state where a radially outward end of a scraper member contacts an inner wall of a holder.
Figure 8:
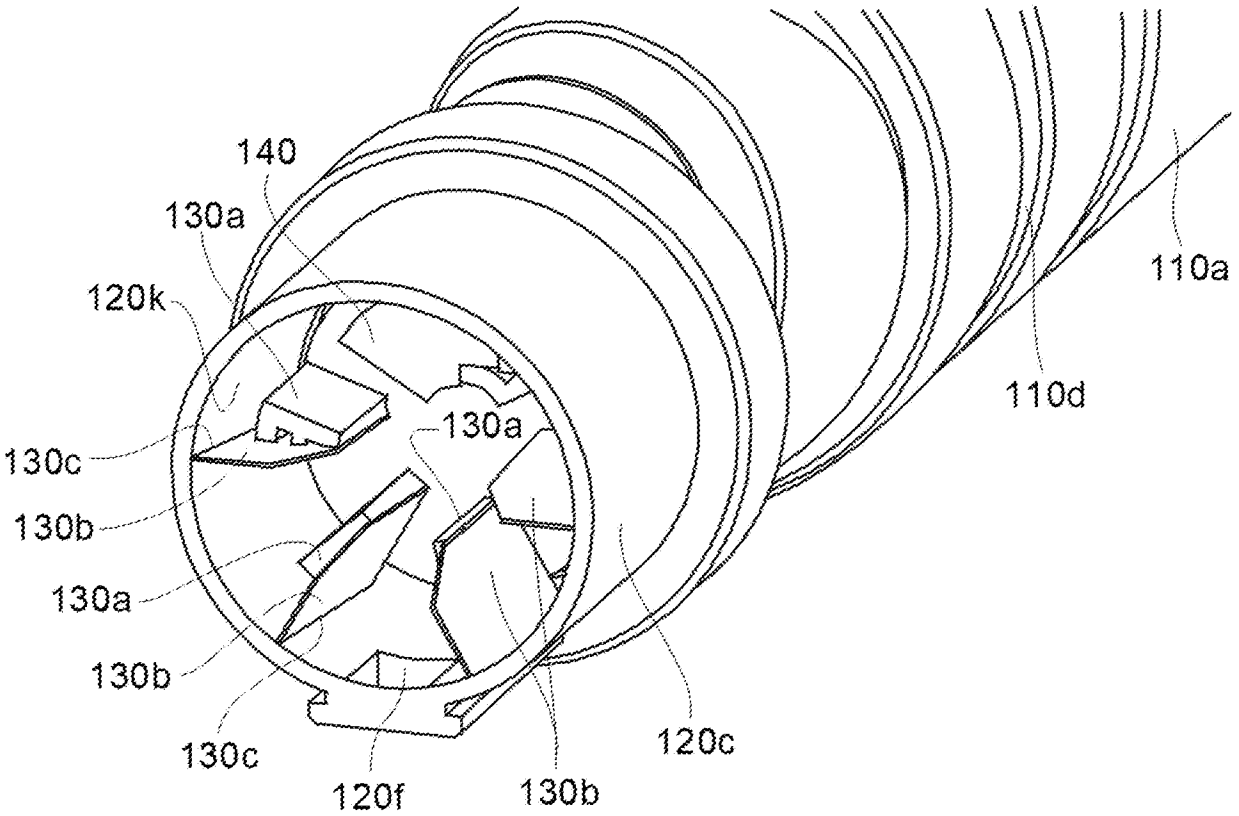
FIG. 8 is a perspective view illustrating a toner/developer discharge port of the holder of FIG. 7.

FIG. 7 is a cross-sectional view of a portion of the toner container 110 and the developer container 120, taken along a plane that intersects the cylinder axis X, in a state where they are coupled together by such snap-fitting. FIG. 8 is a perspective view of the components illustrated in FIG. 7, showing a cross section of the holder 120*c*, taken along a plane perpendicular to the cylinder axis X near the toner/developer discharge port 120*f*. FIGS. 7 and 8 show a state where a radially outward end (or free end) 130*c* of the scraper member 130*b* contacts an inner wall 120*k* of the holder 120*c*.

With reference to FIG. 7, the end 130*c* of the scraper member 130*b* to contact with the inner wall 120*k* of the holder 120*c* extends in a direction slightly intersecting a direction parallel with the cylinder axis X of the holder 120*c*, and a tolerance angle thereof is expressed by reference letter a in the figure. Accordingly, the scraper member 130*b* sweeps the developer in the holder 120*c* out toward the toner/developer discharge port 120*f* shown by arrow F in FIG. 7 by a rotation of the developer transport member 130 and the bottle 110*a* rotate in a clockwise direction C, for example with reference to FIG. 4, when viewed from the side of the developer transport mechanism 130 toward the bottle 110*a*.

Figure 9:
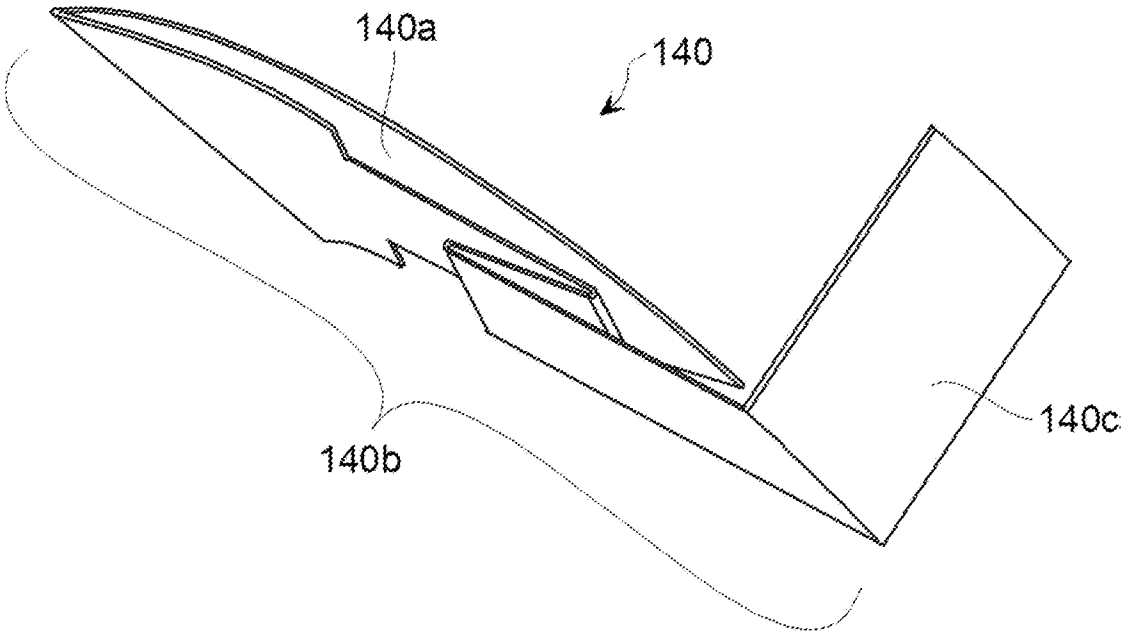
FIG. 9 is a perspective view showing an example sealing member.
Figure 10:
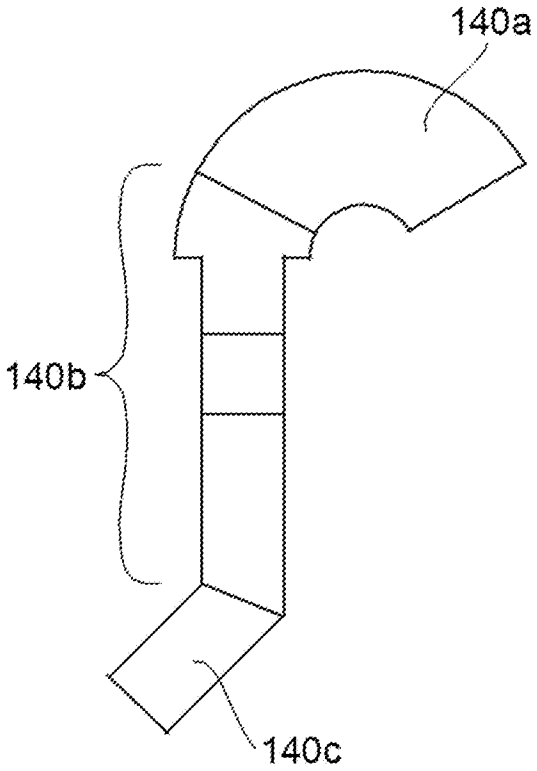
FIG. 10 is a planar development view of the sealing member illustrated in FIG. 9.

FIG. 9 is an enlarged perspective view of the sealing member 140 shown in FIG. 3, and FIG. 10 is a planar developed view thereof. As shown in FIG. 4, the sealing member 140 is joined to the periphery of the toner discharge port 110*g* of the cap member 110*c* to have a first end portion 140*a* having a fan-like shape for sealing the toner discharge port 110*g*. The sealing member 140 also has an intermediate portion 140*b* folded alternately along three creases. This configuration allows the intermediate portion 140*b* to be extendable up to a predetermined length, until the creases of the intermediate portion 140*b* are all extended completely, while preventing intermediate portion 140*b* to be extended beyond the predetermined length. The sealing member 140 also has a second end that is bent along a fourth crease and joined to the inner wall 120*k* of the holder 120*c*. The joint between the first end portion 140*a* of the sealing member 140 and the cap member 110*c*, and the joint between the second end 140*c* of the sealing member 140 and the holder 120*c* are carried out such that the attaching force of the first end portion 140*a* of the sealing member 140 to the cap member 110*c* is less than the attaching force of the second end portion 140*c* of the sealing member 140 to the inner wall 120*k* of the holder 120*c*. This can be carried out, for example, by using two kinds of double-sided tapes or adhesives having different attaching forces, different attaching surfaces, and/or the like.

Figure 11:
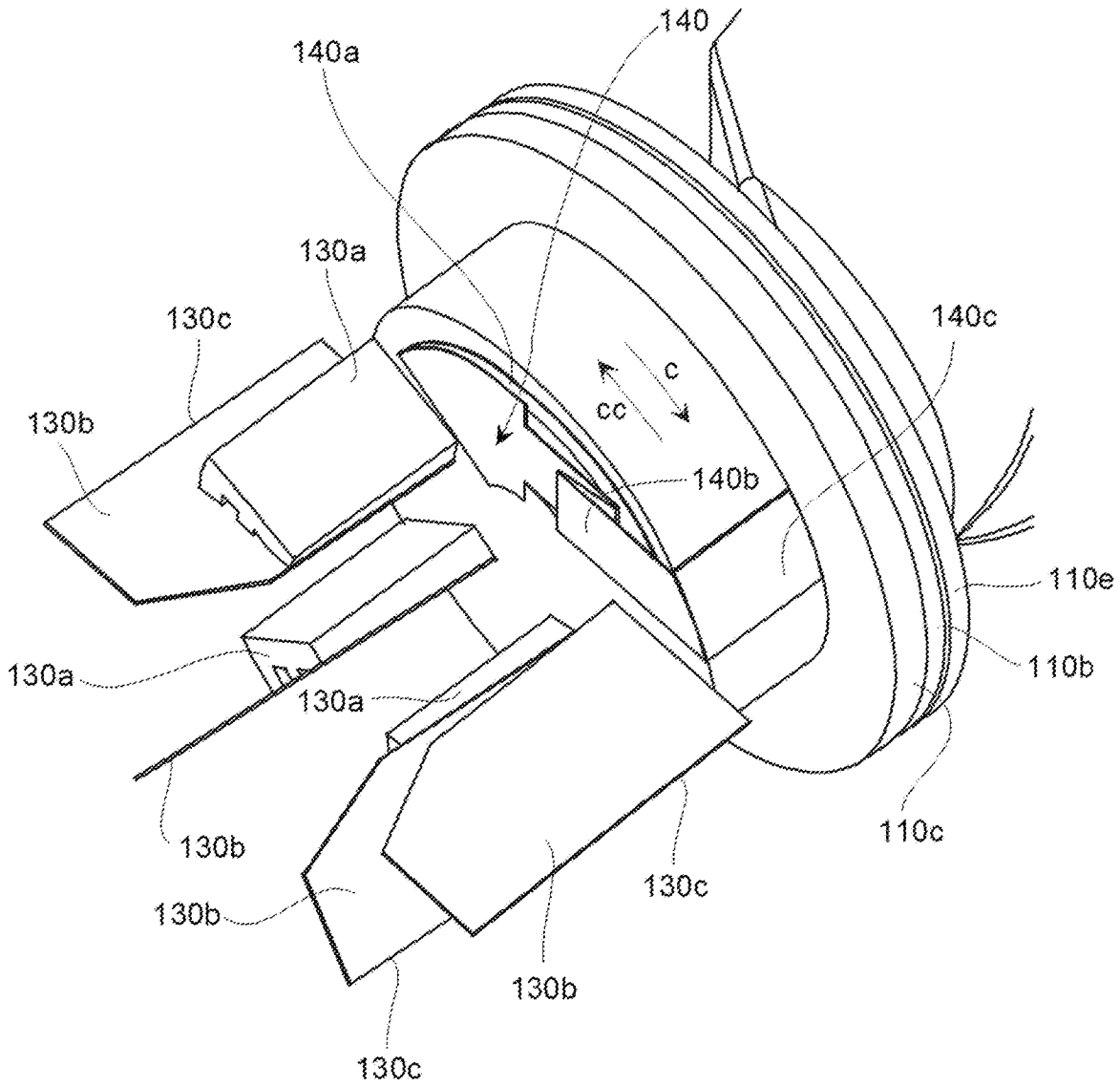
FIG. 11 is a partial perspective view of an example toner/developer cartridge 100, illustrating a state where the developer container is omitted.

An example operation of the toner/developer supply device will be described with reference to FIG. 11, which is a perspective view showing a state of the example toner/developer cartridge 100 without the developer container 120. Hereafter, explanation will be made on the premise that the second end portion 140*c* of the sealing member 140 is attached to the inner wall 120*k* of the holder 120 of the developer container 120.

According to a first case, the cap member 110*c* repeatedly rotates in a clockwise direction C and a counterclockwise direction CC within a predetermined range of angles (e.g., within a range of threshold rotational angles). When the cap member 110*c* rotates in the counterclockwise direction CC from the state shown in the figure, the intermediate portion 140*b* of the sealing member 140 gradually extends its folded portion and becomes unextendable when the folded portion is completely extended (e.g., when the sealing member 140 is shaped in a fully extended state). When the cap member 110*c* rotates in the clockwise direction C from that state, the completely extended folded portion returns to the original state, so as to return to the state shown in FIG. 11. Thus, when the predetermined range of angles for the rotation of the cap member 110*c* corresponds to, for example, such a range from the state shown in FIG. 11 to the state where the intermediate portion 140*b* of the sealing member 140 is completely extended as described above, the first end portion 140*a* of the sealing member remains attached to the cap member 110*c*. In the case that such rotations are repeated, when the cap member 110*c* rotates in the clockwise direction C, the developer contained in the holder 120*c* is swept by the scraper member 130*b* and discharged from the toner/developer discharge port 120*f*.

In addition, as described above, the attaching force of the first end portion 140*a* of the sealing member 140 to the cap member 110*c* is less than the attaching force of the second end portion 140*c* of the sealing member 140 to the inner wall 120*k* of the holder 120*c*. Accordingly, when the cap member 110*c* continues to rotate in the counterclockwise direction CC after the intermediate portion 140*b* of the sealing member 140 is brought into an unextendable state (e.g., when the sealing member 140 is shaped in a fully extended state), the second end portion 140*c* of the sealing member 140 remains attached to the inner wall 120*k* of the holder 120*c* while the first end portion 140*a* of the sealing member 140 is detached from the cap member 110*c*. Consequently, the toner discharge port 110*a* of the cap member 110*c* is opened, thereby providing fluid communication between the toner discharge port 110*g* and the toner inlet port 120*i* of the holder 120*c*. For example, the spiral projection 110*d* of the bottle 110*a* shown in the figures is for moving the toner within the bottle toward the toner discharge port 110*g* when the bottle 110*a* rotates in the counterclockwise direction CC. Thus, after the first end portion 140*a* of the sealing member 140 is detached from the cap member 110*c*, a continuous rotation of the bottle 110*a* in the counterclockwise direction CC enables the toner to be discharged from the opened toner discharge port 110*g*.

Examples of the toner/developer supply device in use will be described.

According to examples, when the image forming apparatus 1 is installed at a customer's site, the toner/developer cartridge 100 is mounted to the image forming apparatus 1 and the image forming apparatus 1 is powered for the first time to start an initialization of the developing device 50. The initialization of the developing device 50 mentioned herein refers to a process to store in the image forming apparatus a voltage that is detected by a toner concentration sensor from a developer charged first into the developing device 50 and corresponds to an appropriate toner concentration. When the initialization of the developing device is started, the developing device not charged with a developer within the image forming apparatus is driven by a motor to rotate the stirring-transporting members 54, 56 and the developing roller 52 inside the developing device 50. At the same time, the toner container 110 of the toner/developer cartridge 100 is repeatedly rotated in the clockwise direction C and the counterclockwise direction CC within a predetermined range of angles (e.g., within a range of threshold rotational angles). This allows the developer transport mechanism 130 to discharge the developer in the developer container 120 from the toner/developer discharge port 120*f* of the developer container 120, and the developer is transported to the developing device 50. At this time, the first end portion 140*a* of the sealing member 140 seals the toner discharge port 110*g* of the cap member 110*c*, to prevent the toner in the toner container 110 from flowing into the developer container 120.

The developer to be filled into the developing device 50 should have a suitable targeted toner concentration. When the developer is filled into the developing device 50, the toner in the toner container 110 may flow into the developer container 120 so as to change the toner concentration of the developer in the developer container. In the toner/developer cartridge 100, the toner discharge port 110*g* of the toner container 110 can be more reliably sealed by the sealing member 140 when the developer is filled into the developing device 50, for example, when the toner container 110 rotates within a predetermined range of angles (e.g., within a range of threshold rotational angles) relative to the developer container 120.

After all of the developer in the developer container 120 is fed into the developing device 50, the stirring-transporting members 54, 56 and the developing roller 52 are rotated for a predetermined time period. When the toner concentration sensor detects a concentration of the developer correctly, the driving of the developing device 50 is stopped and the initialization of the developing device 50 is ended, bringing into a print-ready state.

When the toner concentration in the developing device 50 is decreased by regular printing operations, the toner container 110 rotates beyond the predetermined range of angles in a predetermined direction (for example, the counterclockwise direction CC in FIG. 4). This detaches the first end portion 140*a* of the sealing member 140 from the cap member 110*c* to open the toner discharge port 110*g*. The toner in the toner container 110 is discharged through the toner discharge port 110*g* to the developer container 120 and then discharged through the toner/developer discharge port 120*f* of the developer container 120, so that it is supplied to the developing device 50.

Thereafter, when the toner in the toner/developer cartridge 100 is consumed and exhausted by further printing operations, toner replenishment can be carried out selectively or exclusively. For example, the toner/developer cartridge 100 that does not contain any developer in the developer container 120 and that contains a toner in the toner container 110 may be used to carry out the toner replenishment. In some examples, after a service personnel takes out all of the deteriorated developer from the developing device 50, developer replacement and toner replenishment can be simultaneously carried out by use of the above-described toner/developer cartridge 100 that contains a developer in the developer container 120 and contains a toner in the toner container 110.

According to another example case, the developing device 50 has a developer discharge mechanism for discharging a deteriorated developer described.

The developer discharge mechanism can be formed, for example, by providing in the developing device 50, a developer discharge port disposed within a circulation path of a developer in the developing device 50; and an opening/closing mechanism such as a shutter, which is disposed at a portion of a frame or the like for circulating the developer and opens/closes the developer discharge port. In this case, the opening/closing mechanism opens the developer discharge port, so as to discharge a deteriorated developer from the developing device 50.

The developer discharge mechanism can be also implemented by disposing in the image forming apparatus 1, a control part to control a surface potential of the image carrier 30 of the image forming apparatus 1 and a developing bias potential of the developing roller 52 of the developing device 50. In this case, the control part controls the surface potential of the image carrier 30 and the developing bias potential of the developing roller 52 to attach a deteriorated developer to the image carrier 30, so that the deteriorated developer attached to the image carrier 30 can be scraped and discharged by the blade 71 of the cleaning device 70.

When the toner/developer cartridge 100 is used in the image forming apparatus 1 having such a developer discharge mechanism, operations from the time of mounting of the toner/developer cartridge 100 to the image forming apparatus 1 after installation of the image forming apparatus 1 with the developing device 50 containing no developer, to the time of an exhaustion of the toner contained in the toner/developer cartridge 100 are the same as the above-described operations of the image forming apparatus without the developer discharge mechanism. Meanwhile, when the toner of the toner/developer cartridge 100 is exhausted, the developer discharge mechanism may operate to discharge a small amount of developer within the developing device 50. A message for drawing a user's attention to replace the toner/developer cartridge 100 may be displayed on a control panel of the image forming apparatus 1 so that the user replaces the toner-exhausted toner/developer cartridge 100 with a new toner/developer cartridge 100.

This new toner/developer cartridge 100 is different from the above-described toner/developer cartridge 100 where a predetermined amount of developer for an empty developing device is contained in the developer container 120, and it contains in a developer container 120 a new developer in the same amount as the "small amount of developer" discharged by the developer discharge mechanism. Once the new toner/developer cartridge 100 is mounted to the image forming apparatus 1, the developer device 50 is driven, the toner container 110 is repeatedly rotated within a predetermined range of angles (e.g., within a range of threshold rotational angles) and the developer in the developer container 120 is supplied to the developing device 50 in the same manner as when the toner/developer cartridge 100 is first mounted. When regular printing operations are resumed, the toner container 110 rotates in a predetermined direction to detach the first end portion 140*a* of the sealing member 140 from the cap member 110*c*, so that the toner is supplied to the developing device 50. When the toner in the toner/developer cartridge 100 is exhausted, a replacement of portion of the developer in the developer device 50 can improve the printing quality. Accordingly, the "small amount of developer" discharged by the above-described developer discharge mechanism involves a minimum amount of developer to be replaced for improvement of the printing quality. Such a minimum amount of developer depends on the size or structure of the developing device 50, or the properties of the developer or toner.

As described above, the toner/developer supply device can automatically supply a developer in addition to a toner. Accordingly, at the time of installation of an image forming apparatus, a service personnel does not have to perform complex tasks such as charging a developing device with a developer. Consequently, installation of an image forming apparatus can be completed easily and within a shorter time period, while also reducing or eliminating any risk of contamination within the image forming apparatus or in the vicinity thereof at the time of filling with a developer.

Since the toner/developer supply device can also supply a developer in addition to a toner, an image forming apparatus can be shipped out without charging a developing device with a developer. Accordingly, unlike the case where an image forming apparatus is shipped out with a developing device filled with a developer, many sealing members or packaging materials to prevent a leak of the developer do not have to be disposed in the developing device or the like within the image forming apparatus, so as to reduce the production cost of the image forming apparatus. In addition, when an image forming apparatus is shipped out without a developing device filled with a developer, it is not necessary to dispose, for example, a developer reservoir in the developing device, so as to reduce the size and manufacturing costs of the developing device.

In addition, when a developer discharge mechanism to discharge a deteriorated developer is disposed in an image forming apparatus, the toner/developer supply device can cooperate with the developer discharge mechanism to automatically and periodically replace at least part of the deteriorated developer with a new developer. Thus, an image forming apparatus with a simple configuration allows to keep the amount and the quality of the developer in the developing device more constant, so as to maintain a printing quality, without having a service personnel replace the developer, which may involve a trickle development method or the like with a complex mechanism and control.

Although the example sealing member 140 has four creases, according to examples, the sealing member may be provided with six or more creases. In addition, although the first end portion 140*a* of the sealing member 140 and the toner discharge port 110*g* have a fan-like shape in FIG. 3, in some examples, the first end portion 140*a* and/or the toner discharge port 110*g* can have any other suitable shape.

In addition, in the example toner/developer cartridge 100, when the developer container 120 is configured to incline downward to the toner/developer discharge port 120*f*, the end 130*c* of the scraper member 130*b* according to examples, may extend in a direction parallel with the cylinder axis of the developer container 120, so as not to intersect with the direction parallel with the cylinder axis.

In addition, although the bottle 110*a*, the seal ring 110*b* and the cap member 110*c* are attached together by use of a double-sided tape or the like in the above described examples, other suitable attaching structures may be used. For example, the holder 120*c* and the bottle 110*a* can be coupled together by snap-fitting with the seal ring 110*b*, the cap member 110*c* and the seal ring 120*a* being accommodated within the holder 120*c* without the bottle 110*a*, the seal ring 110*b* and the cap member 110*c* being attached together. Accordingly, a material for each of the bottle 110*a*, the seal ring 110*b* and the cap member 110*c* is to be selected such that a frictional force among the bottle 110*a*, the seal ring 110*b* and the cap member 110*c* is greater than a frictional force between the seal ring 120*a* and the cap member 110*c*, to rotate the bottle 110*a*, the seal ring 110*b* and the cap member 110*c* in an integrated manner relative to the holder 120*c*, such that the bottle 110*a*, the seal ring 110*b* and the cap member 110*c* are rotationally fixed to each other.

Additionally, according to examples, the toner container 110 may not be composed of the bottle 110*a*, the seal ring 110*b* and the cap member 110*c*. For example, the toner container 110 can be configured by directly joining the cap member 110*c* to the bottle 110*c* without the seal ring 110*b*. The toner container 110 can be also configured by integrally molding the cap member 110*c* and the bottle 110*a*.

Additionally, although the example developer transport mechanism 130 includes four ribs 130*a* disposed on the surface of the cap member 110*c*, and four scraper members 130*b* joined to the four ribs 130*a*, respectively, the developer transport mechanism may have other suitable configurations. For example, the developer transport mechanism 130 can be configured by integrally molding the scraper member 130*b* with the cap member 110*c* without the ribs 130*a*.

In addition, although the example bottle 110*a* is formed by blow molding, the bottle may be formed with other suitable methods. For example, developer transport mechanism can be produced by injection-molding halves thereof and fusing them together.

In addition, although FIG. 1 shows a monochrome printer, the toner/developer supply device can be applied to any of color printers, monochrome printers, and/or the like.

It is to be understood that not all aspects, advantages and features described herein may necessarily be achieved by, or included in, any one particular example. Indeed, having described and illustrated various examples herein, it should be apparent that other examples may be modified in arrangement and detail is omitted.

The invention claimed is:

1. A toner-and-developer supply device, comprising:

a toner container to contain toner, the toner container having a toner discharge port, wherein the toner container is rotatable about a rotational axis to transport the toner toward the toner discharge port; and a developer container to contain a developer, the developer container having a toner-and-developer discharge port, wherein the developer container is rotatably coupled to the toner container to transport the developer toward the toner-and-developer discharge port when the toner container rotates in a given direction relative to the developer container.

2. The toner-and-developer supply device according to claim 1, wherein the toner container has a toner inlet port, and wherein the toner-and-developer supply device includes a seal to seal the toner discharge port, and wherein the seal is removable from the toner discharge port of the toner container to fluidly couple the toner discharge port to the toner inlet port when the toner container rotates relative to the developer container beyond a range of threshold angles.

3. The toner-and-developer supply device according to claim 2, wherein the seal comprises a first end attached to a periphery of the toner discharge port of the toner container to seal the toner discharge port, an intermediate portion that is extendable to a maximum length, and a second end attached to the inner wall of the developer container, and wherein an attaching force of the first end of the seal to the periphery of the toner discharge port of the toner container is less than an attaching force of the second end portion of the seal to the inner wall of the developer container.

4. The toner-and-developer supply device according to claim 1, wherein the toner container has an inner wall that forms a spiral projection to transport the toner toward the toner discharge port, and wherein toner-and-developer supply device includes a developer transport device disposed at a longitudinal end of the toner container, wherein the developer transport device comprises a scraper having a free end that extends radially outwardly within the developer container to contact an inner wall of the developer container, and wherein the free end additionally extends in a direction substantially parallel with the rotational axis of the developer container.

5. The toner-and-developer supply device according to claim 4, wherein the free end of the scraper additionally extends in a direction intersecting a direction parallel with the rotational axis of the developer container.

6. The toner-and-developer supply device according to claim 1, wherein the developer container comprises an openable closure device to close the toner-and-developer discharge port of the developer container, the openable closure device to open the toner-and-developer discharge port when the toner-and-developer supply device is mounted to an image forming apparatus.

7. The toner-and-developer supply device according to claim 1, wherein the toner container comprises a bottle having a substantially cylindrical shape that extends longitudinally along the rotational axis, wherein the bottle includes an open end forming an opening, and a cap member coupled to the open end of the bottle, and wherein the toner discharge port of the toner container is formed in the cap member to fluidly couple with the opening of the bottle.

8. The toner-and-developer supply device according to claim 7, wherein the developer container includes a snap-fit connector to couple the developer container with the bottle by snap-fitting, such that the cap member and the open end of the bottle are located within the developer container, to rotate the cap member and the bottle relative to the developer container.

9. An image forming apparatus comprising:

a toner-and-developer supply device that includes:

a toner container to contain toner, the toner container having a toner discharge port, wherein the toner container is rotatable about a rotational axis to transport the toner toward the toner discharge port; and a developer container to contain a developer, the developer container having a toner-and-developer discharge port, wherein the developer container is rotatably coupled to the toner container to transport the developer toward the toner-and-developer discharge port when the toner container rotates in a given direction relative to the developer container.

10. The image forming apparatus according to claim 9, wherein the toner container of the toner-and-developer supply device is connected to a rotatably controllable coupling in the image forming apparatus, and the developer container of the toner-and-developer supply device is rotationally fixed in the image forming apparatus.

11. The image forming apparatus according to claim 9, comprising:

a developing device to consume a developer, the toner-and-developer supply device to supply the developing device when the developing device is not charged with developer.

12. The image forming apparatus according to claim 9, comprising:

a developing device having a developer discharge device to discharge deteriorated developer contained in the developing device, to an outside of the developing device, the toner-and-developer supply device to supply the developing device with a new developer in a same amount as the deteriorated developer discharged.

13. The image forming apparatus according to claim 12, wherein the developer discharge device includes a developer discharge port disposed in a circular path of developer in the developing device and an opening/closing device to selectively open and close the developer discharge port, in order to discharge the deteriorated developer when the developer discharge port is open.

14. The image forming apparatus according to claim 12, wherein the developing device includes a developing roller, an image carrier, and a cleaning blade, and wherein the developer discharge device of the developing device includes a controller to control a surface potential of the image carrier and a developing bias potential of the developing roller, in order to cause the deteriorated developer to adhere to the image carrier, the cleaning blade to scrape the deteriorated developer from the image carrier, to discharge the deteriorated developer.

15. A method of supplying a toner and a developer in an image forming apparatus, comprising:

upon mounting to the image forming apparatus a toner-and-developer supply device that includes a developer container and a toner container, discharging the developer contained in the developer container via a toner-and-developer discharge port of the developer container to charge a developing device of the image forming apparatus, by repeatedly rotating the toner container of the toner-and-developer supply device relative to the developer container of the toner-and-developer supply device within a range of threshold angles; and after the charging of the developing device with the developer, replenishing the developing device with the toner by:

rotating the toner container relative to the developer container beyond the range of threshold angles to remove a seal from a toner discharge port of the toner container, and rotating the toner container in a predetermined direction to supply the toner contained in the toner container to the toner discharge port of the toner container, and to the developing device through the toner-and-developer discharge port of the developer container.

* * * * *